US005701641A

United States Patent [19]

Catallo

[11] Patent Number: 5,701,641

[45] Date of Patent: Dec. 30, 1997

[54] SPREADER FOR TUBULAR KNIT FABRICS

[76] Inventor: Frank Catallo, 84 Wheatley Rd., Old Westbury, N.Y. 11568

[21] Appl. No.: 684,097

[22] Filed: Jul. 22, 1996

[51] Int. Cl.[6] ..... D06C 5/00

[52] U.S. Cl. ..... 26/80; 26/84

[58] Field of Search ..... 26/80, 83, 84, 26/51, 81, 85, 86, 99

[56] References Cited

U.S. PATENT DOCUMENTS

| | | | |
|---|---|---|---|
| 964,088 | 7/1910 | Chatfield | 26/84 |
| 2,190,860 | 2/1940 | Cohn | 26/84 |
| 2,590,938 | 4/1952 | Cohn et al. | 26/84 |
| 3,098,279 | 7/1963 | Brunner | 26/83 |
| 3,126,606 | 3/1964 | Beard | 26/83 |
| 3,204,317 | 9/1965 | Hurt et al. | 26/84 |
| 3,479,706 | 11/1969 | Catallo | 26/55 |
| 3,604,079 | 9/1971 | Coates | 26/84 |
| 3,973,304 | 8/1976 | Catallo | 26/84 |
| 4,155,227 | 5/1979 | Conti | 26/83 |

*Primary Examiner*—Amy B. Vanatta
*Attorney, Agent, or Firm*—Leo Fornero

[57] ABSTRACT

A spreader included in tubular knit conditioning or finishing equipment is disclosed and includes a frame serving to support a pair of support members having fabric gripping means mounted on the spaced and oppositely disposed support members. A series of rolls some of which are driven are connected to the fabric gripping means to cause same to move the fabric through the equipment or the spreader. An actuator is connected to the spreader and arranged to move the fabric gripping means to move the fabric while moving through the equipment to adjust for any changes in dimension of the fabric to a desired dimension.

2 Claims, 3 Drawing Sheets

SPREADER FOR TUBULAR KNIT FABRICS

The invention is directed to a spreader, usually included in equipment for conditioning or treating tubular knit fabrics and improves circumferential feed spreaders such as is disclosed in Catallo U.S. Pat. No. 3,973,304. Adding an actuator means for moving the edges of the spreader as the tubular knit fabric is being moved for purposes of spreading same through the spreader.

More particularly most spreaders known to me need to be stopped to adjust the width. Of course this is time consuming and inefficient. It is essential to optimize the spreading of the tubular knit fabric to maintain a desired width so that it is delivered from the spreader in flat state to a further processing step such as dyeing, compressive shrinking, steaming or chemical treatment.

Spreaders constructed according to the invention disclosed herein reduce the usual tensions and other undesirable shortcomings of spreaders that need be stopped such as new fabric stresses on a restart of the spreader and the cutting of holes in the fabric to adjust the spreader width setting.

It is therefore an object of this invention to provide a spreader for use with tubular knit fabrics wherein the fabric width may be changed while the spreader is operative.

Various types of actuators have been used to allow adjustment of the spreader to control fabric width, even in non-circumferential feed spreaders, and none that I am aware of use constant force on the edge grippers through the use of such a force by the application of spring means in a housing where the springs are arranged to provide such a force to the edge grippers. It will be clear that such a system may by used in a circumferential arrangement also.

Another object of this invention is to provide a spreader as described herein that overcomes the deficiencies described above in connection with known spreaders to improve the simplicity and economy of same.

With these and other objectives, the nature of which will be apparent, the invention herein will be more fully understood by reference to the accompanying drawings, the detailed description and the appended claims.

Figure 1:
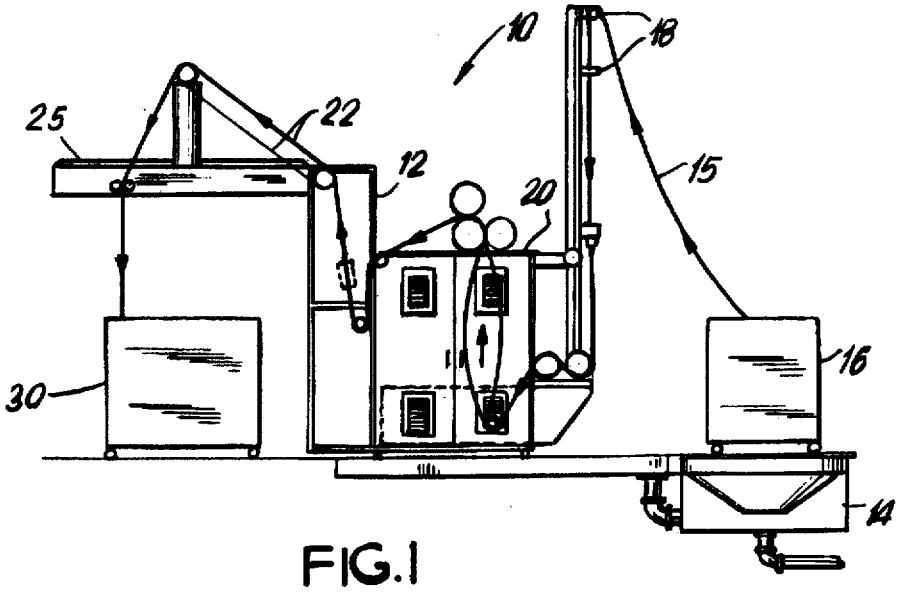
FIG. 1 is a side view showing one type of conditioning equipment which may incorporate a spreader of the type contemplated herein.

Referring now to the drawings for a more detailed description of the invention contemplated herein FIG. 1 is a schematic view of a type of finishing equipment, generally designated 10, where a spreader 12 may be utilized to function as outlined herein. A drain system 14 serves to act as a stagging area for tubular knit fabric 15 in a truck like member 16. The fabric 15 moves through various guiders, generally designated 18 and into a treating area 20. The fabric 15 is moved to the spreader 12 and carried out by a conveyor 22 from where it is folded as desired by a folder 25 and moved to truck 30 for transport to another treatment stage or to the cutting operation. This depends as is well known on the type of processing system being utilized. The type of finishing system described is not intended to be limiting but is provided to set background for the spreader.

Figure 2:
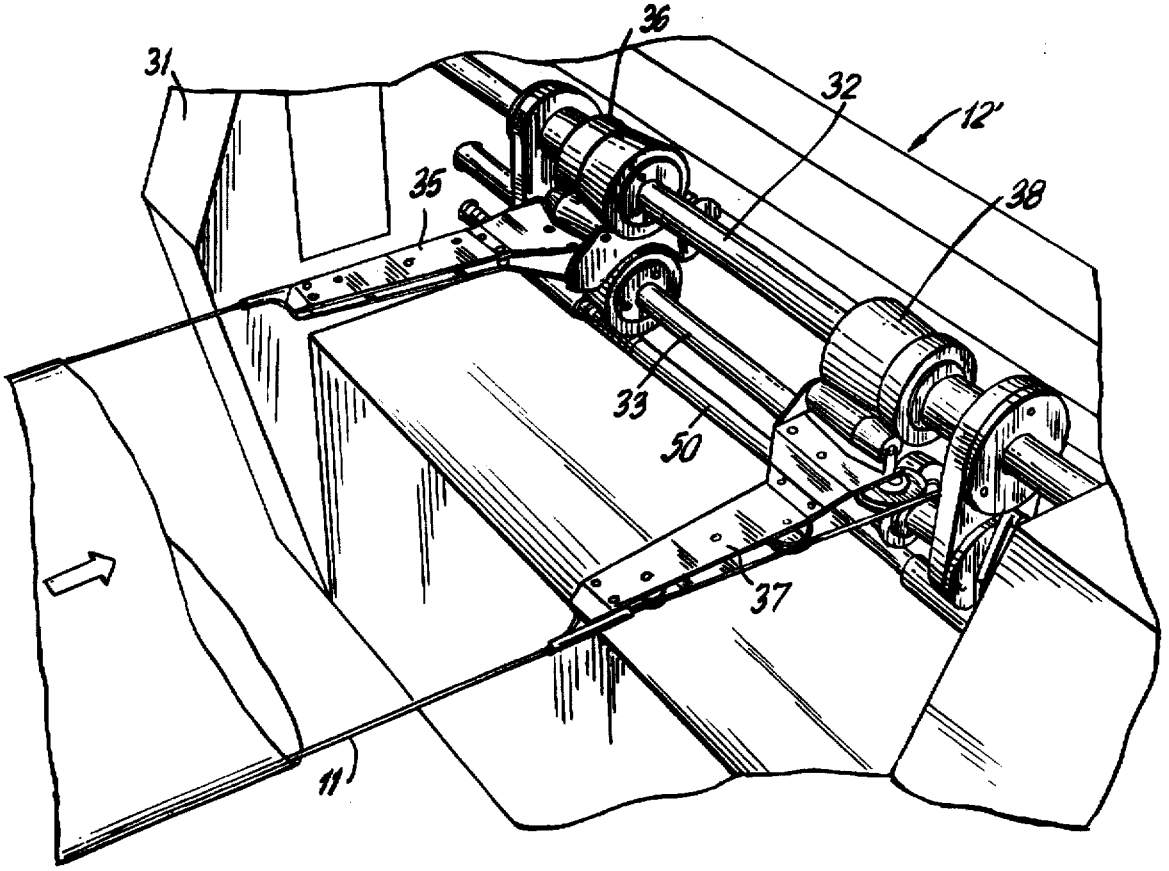
FIG. 2 is a perspective view showing the portion of the spreader wherein the edge grippers include the system for moving these edge grippers to adjust the tubular knit fabric to a desired dimension.

A spreader 12' of the type described herein is shown in FIG. 2 and is mounted in a frame assembly 31 through upper and lower support members or rods 32 and 33. Fabric edge gripping means 35 and 37 are mourned and connected to the supports 32 and 33 as will be described. Normally the fabric gripping means 35 and 37 are disposed to grip the edges of the tubular hilt fabric and move same as these means 35 and 37 are driven in any well known fashion, not shown.

Figure 3:
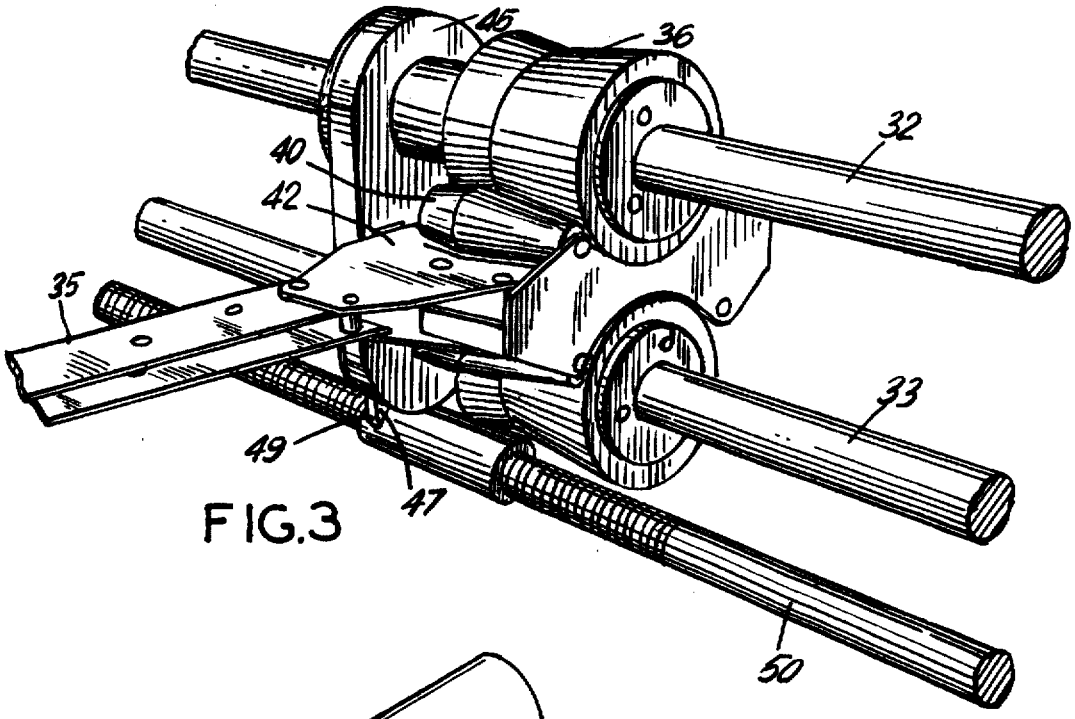
FIG. 3 is a perspective blow-up of the members connected to the fabric gripping means which function to move the edge drive as the machine runs.

On each of the rods 32 and 33 are oppositely spaced pairs of actuator members or rolls 36 and 38—FIG. 2. In FIG. 3 an enlarged actuator is shown and it will be clear to one skilled that while only one actuator 36 is shown an identical unit is mounted opposite the first unit. These rolls function to drive rolls 40 and its sister roll, not shown, both mounted in bracket 42, connected to the fabric edge gripping means 35. A similar actuator arrangement is connected to the fabric edge gripping means 37 and is shown in FIG. 2. There is also included a guide wire 11.

A plate like member 45 for moving the fabric edge grippers to a desired dimension is adapted to slide on rods 32 and 33 of the actuator as shown in FIG. 3. This plate 45 is shown as mounted on rod 32 and includes a tooth 47 mounted in a cut-out 49 formed on the screw shaft or rod 50. The shaft 50 is mounted in the frame 31.

This shaft 50 will move the edge grippers as the plate 45 is moved and in turn moves the rolls to move the roll 40 which in turn moves the edge grippers to the desired dimension.

As mentioned hereinabove a system for sensing width, known in the art, may be associated with the shall 50 and this could automate the adjustment of the fabric dimension.

Figure 4:
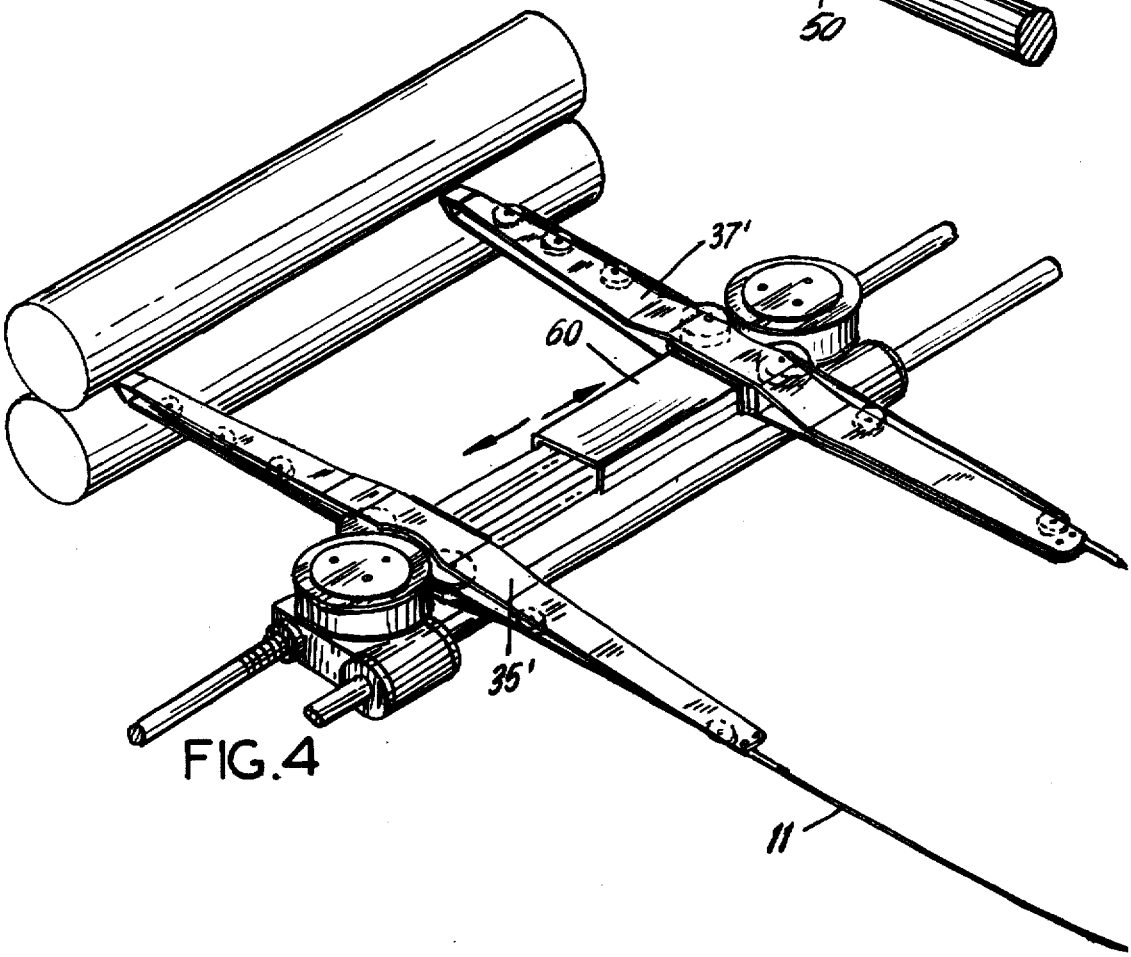
FIG. 4 is a perspective view showing another type of unit to move the edge grippers.

Another arrangement for maintaining the desired dimension is shown in FIG. 4. The edge grippers 35' and 37' are located centrally on the spreader mounted on the frame of the spreader. An actuator 60 is disposed on the spreader 12 and connected to the edge grippers 35' and 37'—FIG. 4.

Figure 5:
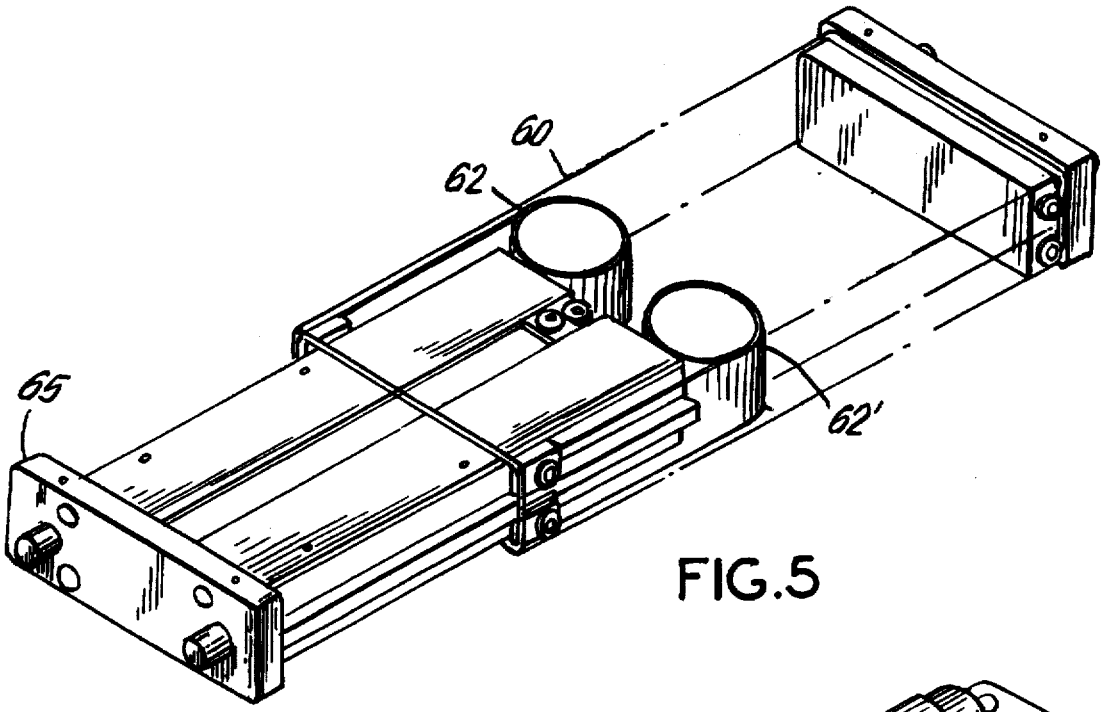
FIG. 5 is a more detailed perspective view showing the make-up of the actuator for moving the edge grippers in FIG. 4; and, FIG. 6 is a perspective view of a telescoping tube that functions to control the center portion of the fabric tube.

An enlarged view of the actuator 60 is shown in FIG. 5 and this unit includes normally loaded springs 62 and 62' pushing the end 65 outwardly so that pressure is exerted on the edge grippers 35' and 37' to keep the fabric spread evenly and in a flat state through its width as it moves through the spreader.

Figure 6:
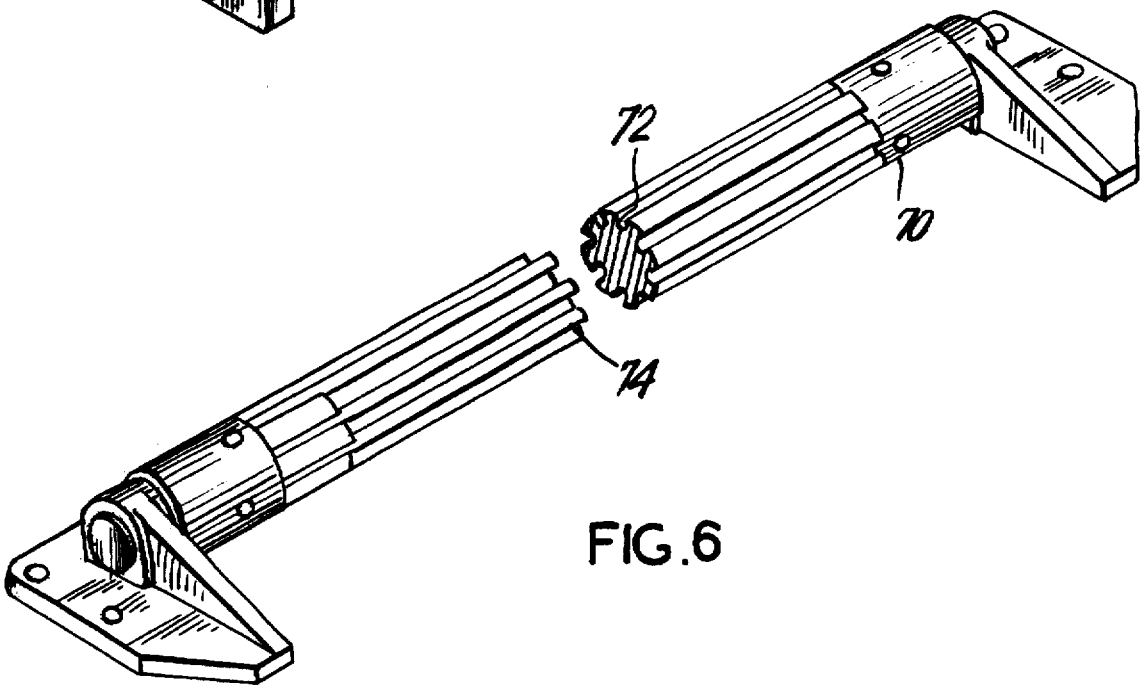

In FIG. 6 there is shown an adjustable tube member 70 which may be rotatably mounted under the fabric and so that it abuts same to maximize the fabrics flat state and the tube itself is made so that it telescopes in and out as a result of the slot 72 and ridge 74 arrangement to provide a completely flat surface to the fabric as it passes over the tube member 70. This flat across the width system cures the problem of tubes that have a space across the length to make the surface uneven as it abuts the fabric.

It is of course to be understood that variations in and modifications of the spreader may be made within the scope of the appended claims.

I claim:

1. A spreader for use in an apparatus for treating tubular knit fabrics comprising;

a) a frame for said apparatus;

b) said frame including spaced support members;

c) said support members arranged to serve as supports for oppositely disposed fabric gripping means which comprise upper and lower rods mounted on the support members;

d) rolls for said apparatus connected to said fabric gripping means;

e) rolls mounted on the lower of said rods and in abutment with the rolls connected to the fabric gripping means;

f) rolls mounted on the upper rod and in abutment with the fabric gripping means;

g) means on said apparatus connected to the upper rod to drive same and drive said rolls mounted on said upper rod to drive said fabric gripping means to move said tubular knit fabric; and h) an actuator means on said apparatus connected to the fabric gripping means to move said tubular knit fabric to a desired dimension.

2. The spreader of claim 1 wherein the actuator comprises an adjustable member to adjustably drive simultaneously the fabric gripping means.

* * * * *